US010864750B2

(12) United States Patent
Ferrari et al.

(10) Patent No.: US 10,864,750 B2
(45) Date of Patent: Dec. 15, 2020

(54) MACHINE FOR THE INK-JET PRINTING OF THREE-DIMENSIONAL OBJECTS, TUBULAR OBJECTS IN PARTICULAR

(71) Applicant: OMSO—OFFICINA MACCHINE PER STAMPA SU OGGETTI—SOCIETA' PER AZIONI, Reggio Emilia (IT)

(72) Inventors: Vittorio Ferrari, Reggio Emilia (IT); Alfredo Campioli, Reggio Emilia (IT)

(73) Assignee: OMSO—OFFICINA MACCHINE PER STAMPA SU OGGETTI—SOCIETA' PER AZIONI, Reggio Emilia (IT)

( * ) Notice: Subject to any disclaimer, the term of this patent is extended or adjusted under 35 U.S.C. 154(b) by 0 days.

(21) Appl. No.: 16/328,918

(22) PCT Filed: Sep. 22, 2017

(86) PCT No.: PCT/IB2017/055759
§ 371 (c)(1),
(2) Date: Feb. 27, 2019

(87) PCT Pub. No.: WO2018/060823
PCT Pub. Date: Apr. 5, 2018

(65) Prior Publication Data

US 2019/0193422 A1 Jun. 27, 2019

(30) Foreign Application Priority Data

Sep. 30, 2016 (IT) ..... 102016000098327

(51) Int. Cl.
*B41J 3/407* (2006.01)
*B41J 2/165* (2006.01)
(Continued)

(52) U.S. Cl.
CPC ..... *B41J 3/4073* (2013.01); *B41J 2/16508* (2013.01); *B41J 2/16517* (2013.01);
(Continued)

(58) Field of Classification Search
CPC .... B41J 2/175; B41J 2/17596; B41J 2/17556; B41J 2/16526; B41J 2/16508;
(Continued)

(56) References Cited

U.S. PATENT DOCUMENTS 5,821,955 A 10/1998 Waschhauser
2005/0157038 A1* 7/2005 Silverbrook ..... B41J 2/04541 347/40

FOREIGN PATENT DOCUMENTS

DE 202015007209 U1 11/2015
EP 2492104 A2 8/2012
(Continued)

OTHER PUBLICATIONS

Third Party Observation filed in connection with PCT application PCT/IB2017/055759, Jan. 11, 2019.
(Continued)

*Primary Examiner* — Jannelle M Lebron
(74) *Attorney, Agent, or Firm* — Browdy and Neimark, PLLC

(57) ABSTRACT

Herein described is a machine (100) for the ink-jet printing of three-dimensional objects (A), comprising: a plurality of spindles individually suitable to carry and drive an object (A) to be printed in rotation around a pre-set rotational axis of the spindle, and a first support and displacement system suitable to displace the spindles in succession along a pre-set loop path, stopping them one after the other in a plurality of operating stations; wherein said operating stations comprise: at least one input station (150) wherein the spindle receives an object (A) to be printed, a plurality of printing stations
(Continued)

wherein the object (A) is ink-jet printed, and at least one output station wherein the printed object (A) is removed from the spindle; wherein each printing station comprises: a printing unit suitable for the ink-jet printing of the object (A) carried by the spindle found in the printing station, and a second support and displacement system suitable to vary the relative position of said printing unit with respect to the spindle found in the printing station; and wherein said printing unit comprises at least: one or more ink-jet printer heads, an ink tank, an ink pump suitable to transfer the ink from the tank to the printer heads, a vacuum pump suitable to create depression in the printer heads, and an electronic apparatus for controlling and commanding the ink pump, the vacuum pump and the printer heads.

14 Claims, 13 Drawing Sheets

(51) Int. Cl.
*B41J 2/175* (2006.01)
*B41J 11/00* (2006.01)

(52) U.S. Cl.
CPC ..... *B41J 2/16526* (2013.01); *B41J 2/16585* (2013.01); *B41J 2/17596* (2013.01); *B41J 11/002* (2013.01)

(58) Field of Classification Search
CPC ..... B41J 2/1652; B41J 2/165; B41J 3/4073; B41J 2/16517; B41J 11/002; B41J 2/16585; B41J 11/0095; B41J 25/308
See application file for complete search history.

(56) References Cited

FOREIGN PATENT DOCUMENTS

| | | | | |
|---|---|---|---|---|
| EP | 2860036 A1 * | 4/2015 | ..... | B41J 25/001 |
| EP | 2977212 A2 | 1/2016 | | |

OTHER PUBLICATIONS

Brochure D240.2, "Hinterkopf", https://www.hinterkopf.de/de/aktuelles/news/details/items/starke-nachfrage-nach-digitaler-druckmaschine-von-hinterkopf.htm (2015).
"Polytopics", Wifag-Polytyp, pp. 1-11, (Mar. 2015).

* cited by examiner

MACHINE FOR THE INK-JET PRINTING OF THREE-DIMENSIONAL OBJECTS, TUBULAR OBJECTS IN PARTICULAR

FIELD OF THE ART

The present invention regards a machine for the ink-jet printing of three-dimensional objects in particular for objects having the shape of a solid of rotation, for example a cylindrical or conical shape. Even more in particular, the invention regards a machine for the ink-jet printing of tubular objects, such as for example drinking glasses, bottles, cans, flacons or other containers having cylindrical or conical surfaces.

STATE OF THE ART

As known, three-dimensional objects like the ones mentioned above are generally decorated at industrial level by means of printing machines that implement the screen printing of flexographic printing, in which the objects to be printed are made to rotate at contact with the printing matrices which enable transferring ink onto the side surface of the object according to a pre-set graphic pattern.

A drawback of these printing machines lies in the low production flexibility, due to the need of creating printing matrices for each type of decoration intended to be obtained and thus the ensuing need of re-equipping the machine with the most suitable printing matrices any time there arises the need to change production.

Another drawback of these machines lies in the fact that the screen and flexographic printing are rather complex processes that generally require the monitoring of expert personnel that, if necessary, is capable of promptly taking action to calibrate the machine and adjust the operating parameters thereof in the most suitable manner.

To overcome these structural limits of the screen and flexographic printing machines, there were proposed machines for the industrial printing of three-dimensional objects implementing an ink-jet printing technique.

Generally, these printing machines comprise a support and displacement system suitable to move the objects to be printed in succession through a plurality of printing stations, at each of which there is at least one printer head suitable to release measured amounts of ink onto the object to be printed. This printer head is generally commanded and controlled by a computerised electronic system, which may be programmed in a relatively simple and quick manner so as to change the decoration or graphic pattern intended to be created on the object to be printed.

Nevertheless, a drawback of the ink-jet printing machines proposed up to now lies in the difficulty of replacing the printer heads in case of malfunction, in that these components are tightly interconnected not only with the ink circuit, but also with the mechanism of the printing machine, thus the disassembly thereof is generally very long and tedious.

Another drawback lies in the difficulty of replacing the ink that is released by the printer head, especially when the new ink should be of a different colour. As a matter of fact, this operation requires that the nozzles of the printer head, and the entire ink circuit connected thereto, be thoroughly cleaned in advance to remove the previous ink, for example using solvents or other substances suitable for the purpose, so as to avoid contaminations that could jeopardise the subsequent printing.

This cleaning step obviously implies rather long production shut-down times and not always with absolute guarantee of a satisfactory result.

In order to avoid these problems, the most common practice is to provide printing machines with a high number of printing stations, each one of which can be designated to operate solely and constantly with an ink having only one pre-set colour.

However, this choice implies a rather considerable increase of both the costs and the overall dimensions of the printing machines, this not always being compatible with the needs of the industry.

Furthermore, a high number of stations implies that some of them may be in-operative for relatively long periods of time, thus entailing the risk of the ink drying in the nozzles of the relative printer heads, damaging them irremediably.

SUMMARY OF THE INVENTION

In light of the above, an object of the present invention is to provide an ink-jet printing machine capable of overcoming or at least considerably reducing the aforementioned drawbacks of the prior art.

Another object is that of attaining this object through a solution that is simple, rational and least expensive possible.

These and other objects are attained by the characteristics of the invention, which are outlined in the independent claims. The dependent claims outline preferred and/or particularly advantageous aspects of the invention.

In particular, an embodiment of the present invention provides a machine for the ink-jet printing of three-dimensional objects comprising:

- a plurality of spindles individually suitable to carry and drive an object to be printed in rotation around a pre-set rotational axis of the spindle, and
- a first support and displacement system suitable to move the spindles in succession along a pre-set loop path, stopping them one after the other in a plurality of operating stations,
  wherein said operating stations comprise:
- at least one input station wherein the spindle receives an object to be printed,
- a plurality of printing stations wherein the object is ink-jet printed, and
- at least one output station wherein the printed object is removed from the spindle,
  wherein each printing station comprises:
- a printing unit suitable for ink-jet printing the object carried by the spindle found in the printing station, and
- a second support and displacement system suitable to vary the relative position of said printing unit with respect to the spindle found in the printing station,
  and wherein said printing unit comprises at least:
- one or more ink-jet printer heads,
- one ink tank,
- one ink pump suitable to transfer the ink from the tank to the printer heads,
- one vacuum pump suitable to create depression in the printer heads, and
- one electronic apparatus for controlling and commanding the ink pump, the vacuum pump and the printer heads.

Thanks to this solution, each printing unit is actually configured as a stand-alone device which incorporates all the means required to perform the ink-jet printing and which can be mounted or demounted on/from the printing machine without having to act on the support and displacement systems or on other mechanical parts.

In other words, the printing machine has a stark separation between the printing unit and the relative support and displacement mechanical systems, with various advantages in terms of efficiency and flexibility in use.

For example, in case of failure or malfunction, each printing unit may be replaced as a whole in a simple and quick manner, without requiring shutting down the printing machine for long periods of time.

Besides this, the printing machine may be provided with a wide range of printing units, which may for example be individually designated to dispense ink of only one pre-set colour and they may be easily replaced on the printing machine according to the specific operating needs.

Generally, it is possible to reduce the number of printing stations to the minimum, thus enabling obtaining a very compact and cost-effective ink-jet printing machine.

According to an aspect of the invention, the second support and displacement system may particularly comprise:

a connection element on which the printing unit is fixed, a first apparatus suitable to displace said connection element along a first direction parallel to the rotational axis of the spindle found in the printing station, a second apparatus suitable to displace said connection element along a second direction perpendicular to the rotational axis of the spindle found in the printing station, and a third apparatus suitable to direct said connection element by rotating it around an axis orthogonal to both said first and second direction.

Thanks to this solution, the printer heads mounted on each printing unit may always be positioned in the most suitable manner with respect to the object to be printed, thus guaranteeing the possibility of always obtaining an optimal result.

For example, the possibility of directing the printing unit enables optimal printing even on conical surfaces.

Another object of the present invention provides for that the printing unit can be fixed to the connection element of the second displacement system through resolvable fixing means i.e. means that can be removed/disconnected to separate the printing unit from the connection element.

Thus, the mounting/demounting of the printing unit is very simple and easy to perform.

According to an aspect of the invention, the first support and displacement system may comprise a platform suitable to rotate around a pre-set revolution axis, on which the spindles are installed according to a radial arrangement with the respective rotational axes directed orthogonally to the revolution axis.

Thanks to this solution, the spindles are moved through the various operating stations of the printing machine in a relatively simple manner, engaging them to follow a circular path which also enables obtaining a rather compact printing machine.

Another aspect of the invention provides for that each spindle can be associated to a third support and displacement system suitable to displace said spindle in a direction parallel to the revolution axis of the platform.

Thus, the position of the spindle can be advantageously adjusted height-wise, for example enabling it to receive objects of different format/diameter.

A further aspect of the invention provides for that each spindle be possibly associated to a lamp suitable to dry the ink released on the object to be printed, said lamp being integrally movable with the respective spindle along the loop path defined by the first actuation apparatus.

Thanks to this solution, the ink released by the printing units on the object to be printed may be immediately dried, avoiding smear and/or defects.

According to an aspect of the invention, a support cylinder suitable to be inserted into the object to be printed can be associated to each spindle.

This aspect of the invention represents a very efficient solution for supporting—during printing—generally tubular-shaped objects, such as for example drinking glasses, bottles, flacons or other containers having cylindrical or conical surfaces A further aspect of the invention provides for that the machine may comprise a first conveyor belt provided with a plurality of cradles individually suitable to receive an object to be printed, said first conveyor belt being suitable to stop each cradle in a release position in which said cradle is longitudinally aligned with the support cylinder of the spindle found in the input station, and wherein the input station comprises a pusher member suitable to push an object to be printed arranged in the cradle found in the release position to insert it into the support cylinder.

Thanks to this solution, the printing machine may be loaded with cylindrical objects of different shape, typically with different diameter and/or length, without having to modify the system.

As a matter of fact, the transversal cradles of the conveyor belt may stably receive cylinders of different diameter and/or length without requiring mechanical modification on the system, while the pusher member pushes each of these cylindrical objects one at a time along the longitudinal extension of the relative cradle until it is inserted into the support cylinder aligned thereto.

According to an aspect of the invention, the machine may also comprise a second conveyor belt provided with a plurality of cradles individually suitable to receive a printed object said second conveyor belt being suitable to stop each cradle in a reception position in which said cradle is longitudinally aligned with the support cylinder of the spindle found in the output station, and wherein the output station comprises a system for transferring the printed object from the support cylinder, found in the output station, to the cradle found in the reception position.

In a manner substantially specular to the explanation above, this solution enables unloading—from the printing machine—cylindrical objects of different shape, typically with different diameter and/or length, without having to modify the system.

Another aspect of the invention provides for that said second conveyor belt can comprise at least one portion that is straight and parallel to a section of the first conveyor belt.

This solution enables an optimal exploitation of the space around the printing machine, in that the empty space between the two conveyor belts can be reduced to the minimum.

Another embodiment of the present invention provides for a system for the ink-jet printing of three-dimensional objects comprising:

the previously described machine a service equipment, wherein said service equipment comprises at least:

one connection element on which a printing unit of the machine can be fixed, and an electronic system that can be connected with the electronic apparatus for controlling and commanding said printing unit, wherein said electronic system is configured at least for:

enabling the operation of the vacuum pump and the ink pump, commanding the printer heads to periodically release a small amount of ink.

Thanks to this solution, the printing units that are not correctly used on the printing machine, for example those that use inks of colours not required for the production in progress or the replacement one, may be advantageously associated to the service equipment which maintains them perfectly operative and ready to be mounted on the printing machine if necessary.

In particular, maintaining the vacuum pump and the ink pump running, and commanding periodic ink release (so-called spitting), the service equipment prevents the ink from solidifying at the microscopic nozzles of the printer heads.

According to an aspect of the invention, the electronic system of the service equipment may be further configured to command the printer heads to perform a pre-set test printing on a sample object.

This enables assessing—manually (through direct monitoring by an operator) or automatically (through a camera)—whether the result of the test printing carried out on the sample object corresponds to the expected result, thus establishing whether the printing unit is operating correctly or whether it requires maintenance.

Another aspect of the invention provides for that the service equipment may further comprise a device for cleaning the printer heads of the external printing unit.

Thanks to this solution, for example should the test printing reveal that some nozzles of the printer heads are clogged or partly clogged, it is advantageously possible to actuate the cleaning device to try to restore complete functionality.

According to an aspect of the invention, this device for cleaning the printer heads may comprise:

a tray for containing a liquid suitable to touch the printer heads, means for generating and propagating ultrasonic waves in the liquid contained in the tray.

This ultrasonic cleaning device has the advantage of enabling a very accurate and thorough cleaning of the printer heads and especially the nozzles thereof, which at times enables completely clearing the totally clogged nozzles which otherwise be entirely unusable.

BRIEF DESCRIPTION OF THE DRAWINGS

Further characteristics and advantages of the invention will be apparent from reading the flowing description—provided by way of non-limiting example—with reference to the figures illustrated in the attached drawings.

DETAILED DESCRIPTION

The figures show an ink-jet printing system (i.e. for decoration through ink jets) for three-dimensional objects, in particular for objects having the shape of a solid of rotation, for example cylindrical or conical-shaped. Even more in particular, the system is designed for the ink-jet printing of tubular objects, such as for example drinking glasses, bottles, cans, flacons or other containers having cylindrical or conical surfaces. In the illustrated example, the system is used for the ink-jet printing of substantially cylindrical-shaped tubular containers A, but they can also be elliptic-shaped or be otherwise shaped.

Figure 1:
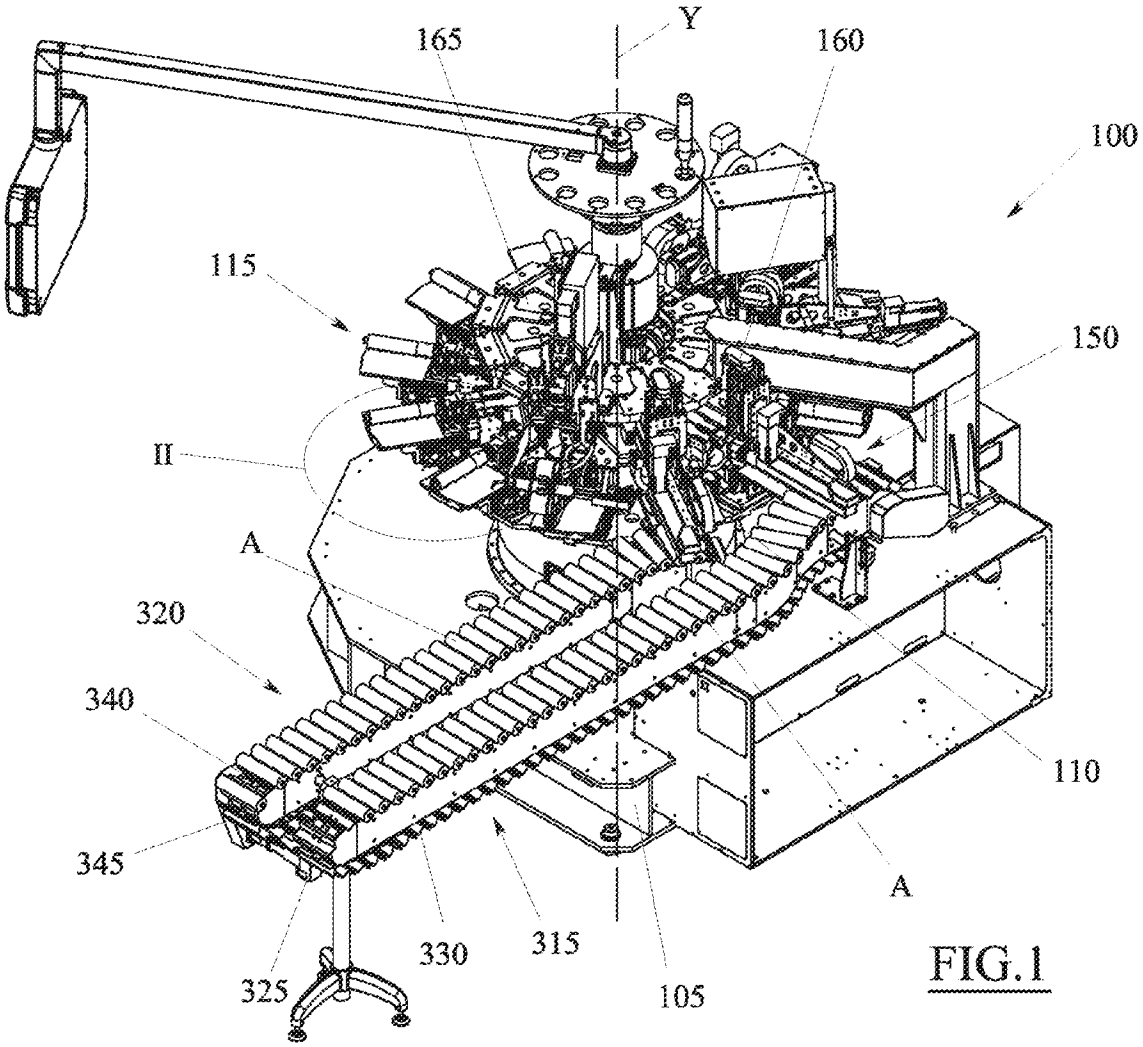
FIG. 1 is an axonometric view of a printing machine according to the present invention

The system comprises an industrial printing machine 100, like the one illustrated in FIG. 1, which is provided with a base 105 for resting against the ground and a first platform 110 set on said base 105. The platform 110 lies in a substantially horizontal plane and it is rotatably coupled to the base 105 through connection means that enable it to rotate around a pre-set vertical axis Y passing through the centre of the platform 110.

A plurality of equipment 115, positioned along the perimeter edge of the platform 110 and suitable to integrally rotate therewith around the vertical axis Y are installed on the platform 110.

Figure 2:
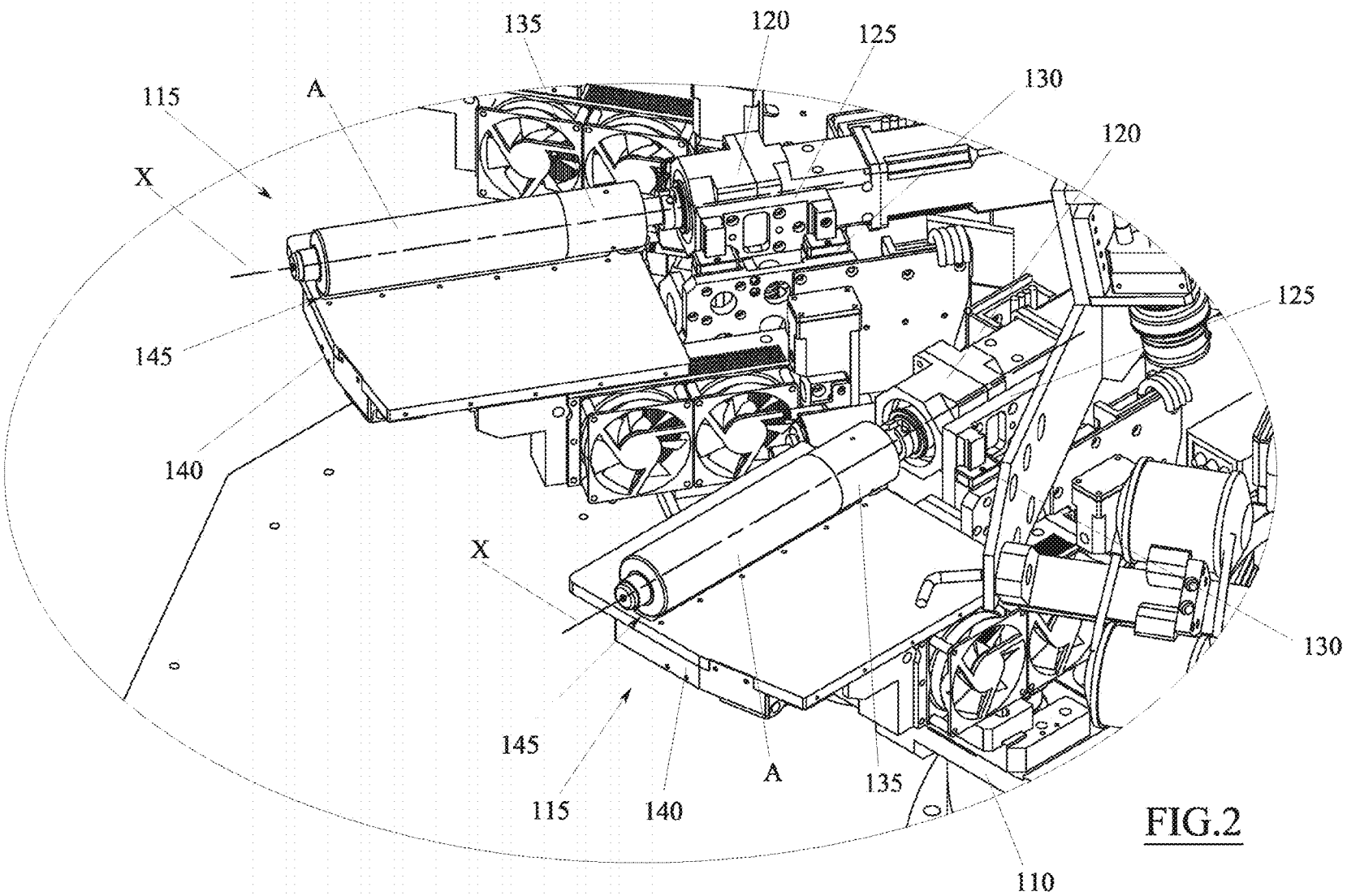
FIG. 2 is the detail of FIG. 1 shown in enlarged scale.

As illustrated in FIG. 2, each equipment 115 comprises a spindle 120 suitable to rotate about itself around a respective horizontal axis X passing through the centre of the spindle 120. The spindles 120 are arranged on board the platform 110 so that the rotation axes X intersect the vertical axis Y and they are arranged in a radial fashion, preferably angularly equally spaced with respect to each other. In addition, the spindles 120 are all arranged at the same radial distance from the vertical axis Y and preferably at the same height above the platform 110.

Each spindle 120 is installed on the platform 110 by interposing connection means which enable adjusting the position thereof height-wise. In this case, these connection means comprise a slide 125, which carries a spindle 120 and it is slidably coupled to a guide system 130 which enable them to slide in vertical direction, actuated by suitable driving means (not illustrated).

A support cylinder 135, which is suitable to receive and support a tubular container A coaxially inserted thereinto, is coupled to each spindle 120. The support cylinder 135 is coaxially locked on the spindle 120, for example by means of a quick coupling and de-coupling system, for example a bayonet connection. Thus, the spindle 120 is suitable to drive the support cylinder 135 and the tubular container A in rotation, rotating it around the respective rotational axis X.

Each equipment 115 further comprises a drying lamp 140, which is vertically positioned beneath the support cylinder 135 to light the tubular container A. In this example, the lamp 140 comprises an outer casing provided with a substantially rectangular window 145, which is arranged beneath the support cylinder 135 and extends longitudinally along a direction parallel to the rotation axis X. A light source, for example a UV rays light source, whose radiation is emitted to the external through the window 145 is received inside the casing. The length and width of the window 145 are smaller than the length and respectively the diameter of the support cylinder 135, so that the radiation generated by the light source can only light the support cylinder 135 and the tubular container A, which thus prevent them from spreading further upwards. The lamp 140 is connected to the platform 110 so as to rotate integrally with the latter around the axis Y, always remaining vertically aligned beneath the respective support cylinder 135.

The rotation of the platform 110 is actuated by suitable driving means (not illustrated), which are configured to rotate it by discrete angular steps, stopping it for a given period after every step. For example, each rotational step may be equivalent to the angular distance separating the rotational axes X of two subsequent spindles 120.

Figure 3:
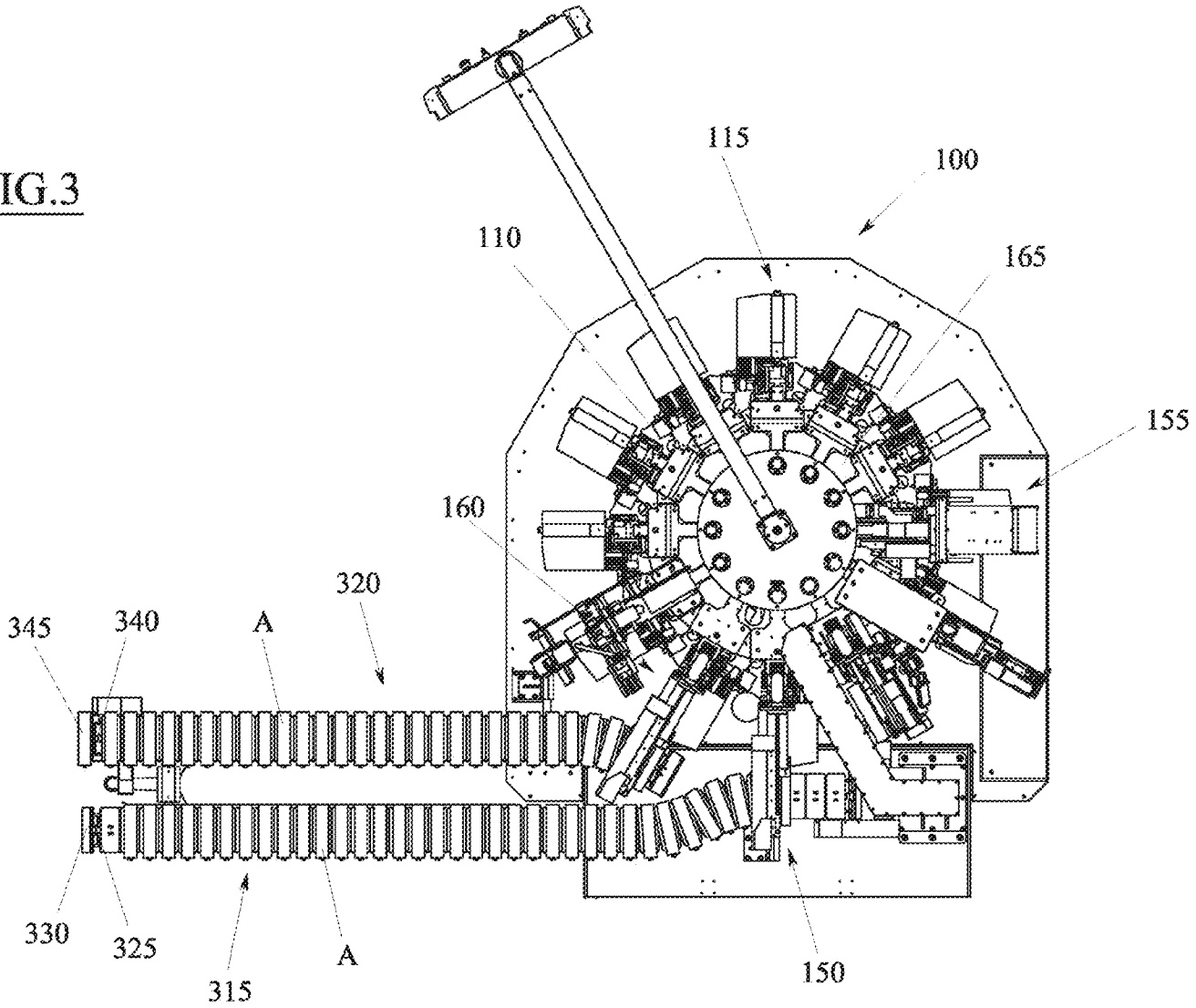
FIG. 3 is a plan view of the machine of FIG. 1.

Thanks to this rotation of the platform 110, the spindles 120 are engaged to travel a circular loop path, along which they are stopped one after the other at a plurality of operating stations. As illustrated in FIG. 3, these operating stations comprise at least one input station 150, in which a cylindrical container A is inserted on the support cylinder 135 carried by the spindle 120, a plurality of printing stations 155 in which the cylindrical container A is ink-jet printed, and an output station 160 in which the cylindrical container A, after being printed, is slipped off the support cylinder 135 and subsequently taken away from the printing machine 100.

It should be observed that the illustrated figures show a single printing station 155 though the printing stations 155 are actually more than one. For example, the printing machine 100 illustrated in the figures is predisposed to house seven printing stations 155, though it cannot be excluded that other embodiments may be equipped with a higher or smaller number of printing stations 155.

The operating stations (input 150, printing 155 and output 160) are installed on a second platform 165 (also see FIG. 1) which is positioned above the first platform 110. The second platform 165 is fixed with respect to the base 105, so that the operating stations are stationary with respect to the spindles 120 which rotate beneath them.

Figure 6:
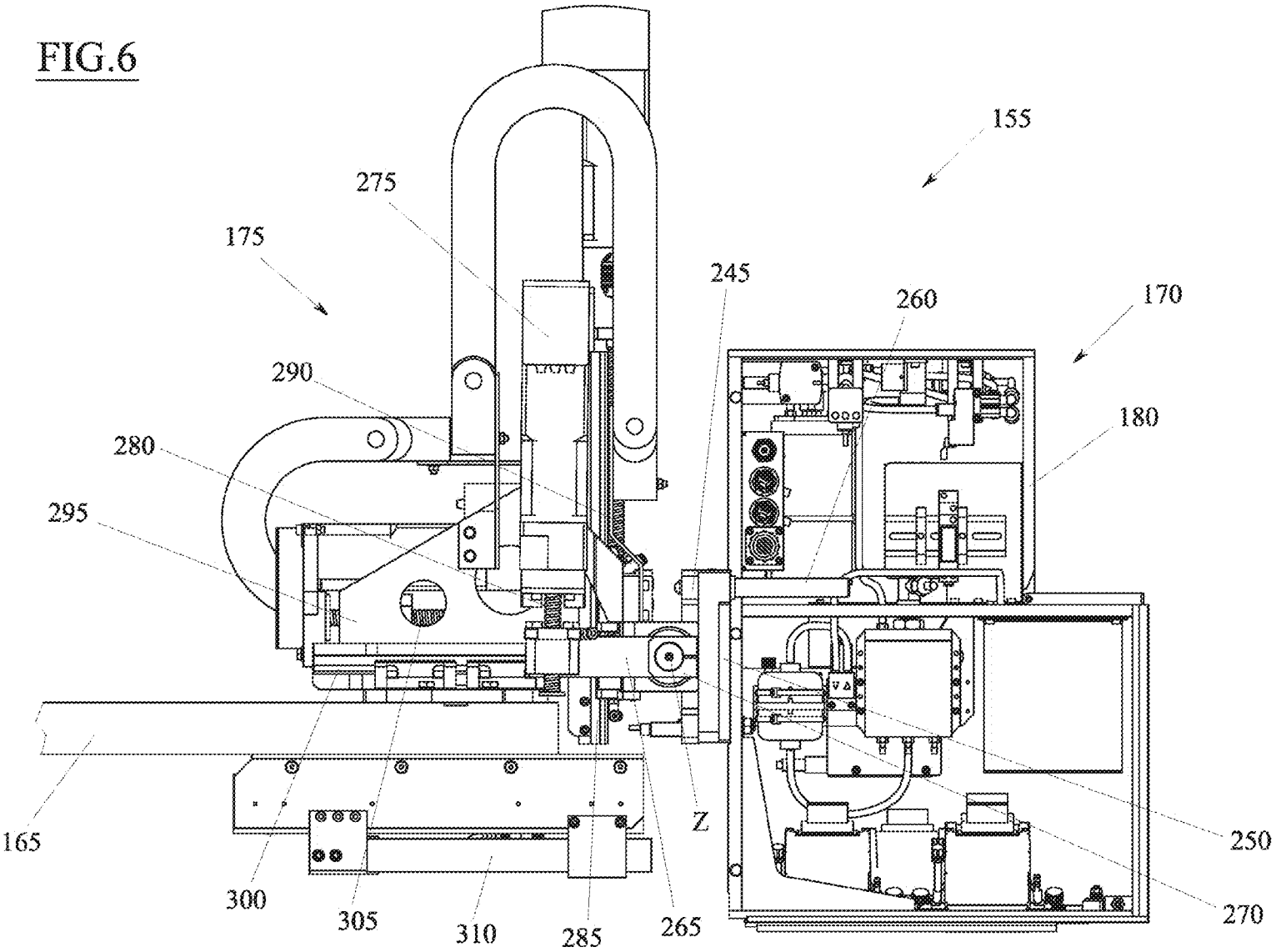
FIG. 6 is a lateral view of a printing station of the machine of FIG. 1.
Figure 7:
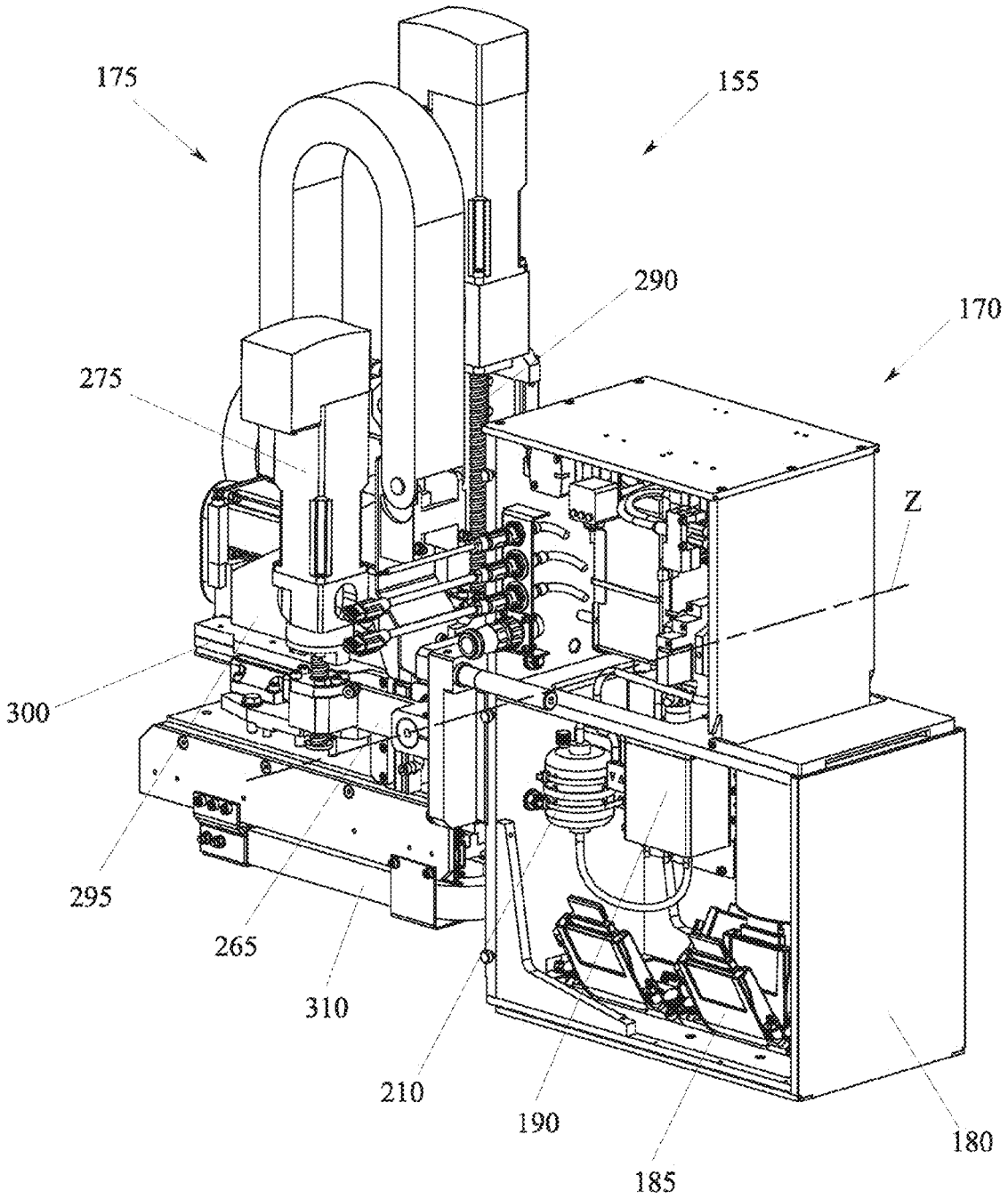
FIG. 7 is an axonometric view of the printing station of FIG. 6.

As illustrated in FIGS. 6 and 7, each printing station 155 comprises a printing unit 170 and a support and displacement system 175 suitable to support said printing unit 170 cantilevered outside the second platform 165 and adjust the position thereof with respect to the spindle 120 and the support cylinder 135 beneath it.

The printing unit 170 comprises a single support structure 180, in this case shaped to form a cabinet, which can be mounted or demounted on the/from the printing machine 100 without having to demount the support and displacement system 175 or other mechanical parts.

Figure 9:
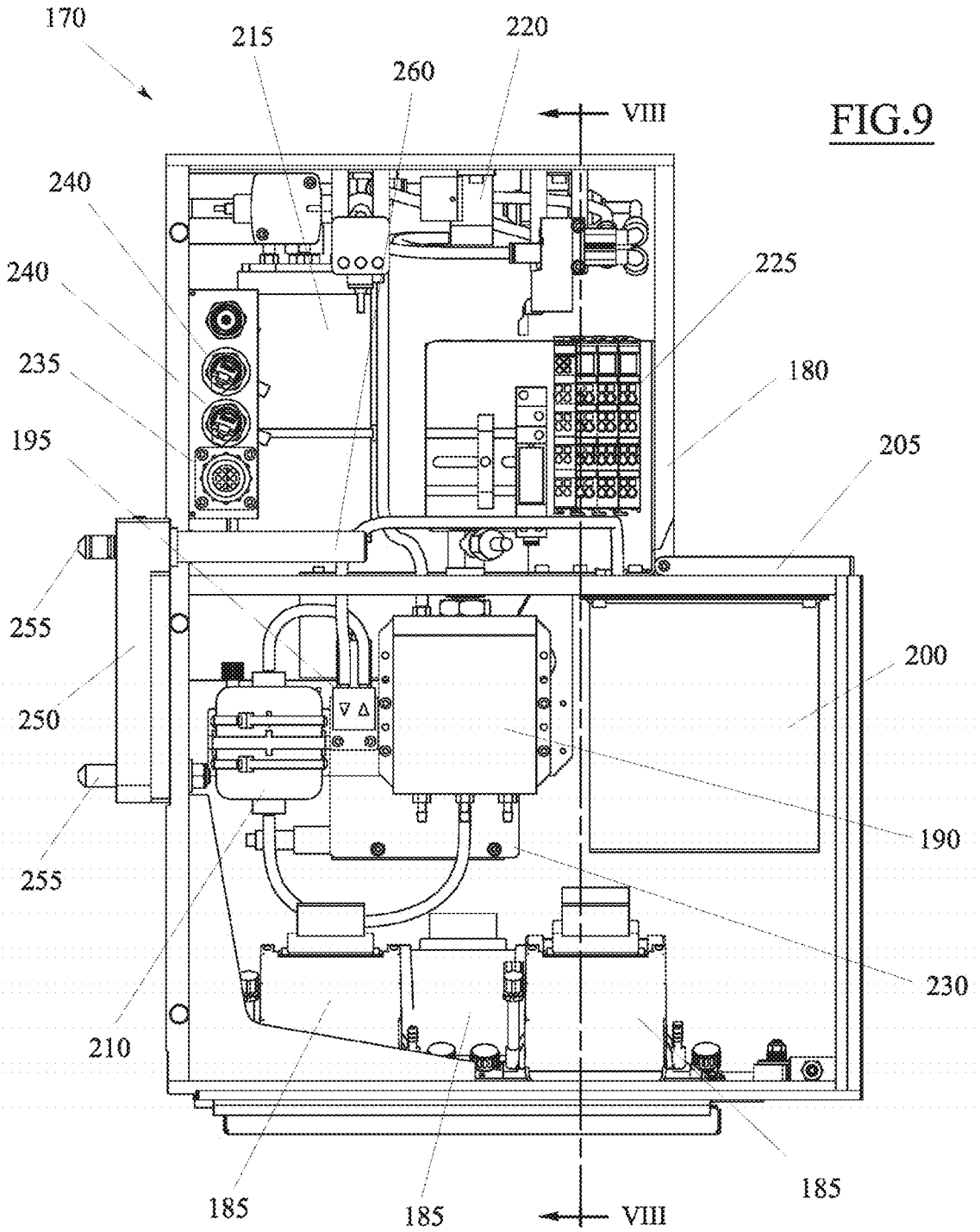
FIG. 9 is a lateral view of the printing units of the printing station of FIG. 6.

As indicated in FIG. 9, the printing unit 170 further comprises one or more printer heads 185, which are positioned in the lower part of the support structure 180, so as to be vertically superimposed with respect to the support cylinder 135 found in the printing station 155, and thus above the cylindrical container A to be printed.

Figure 8:
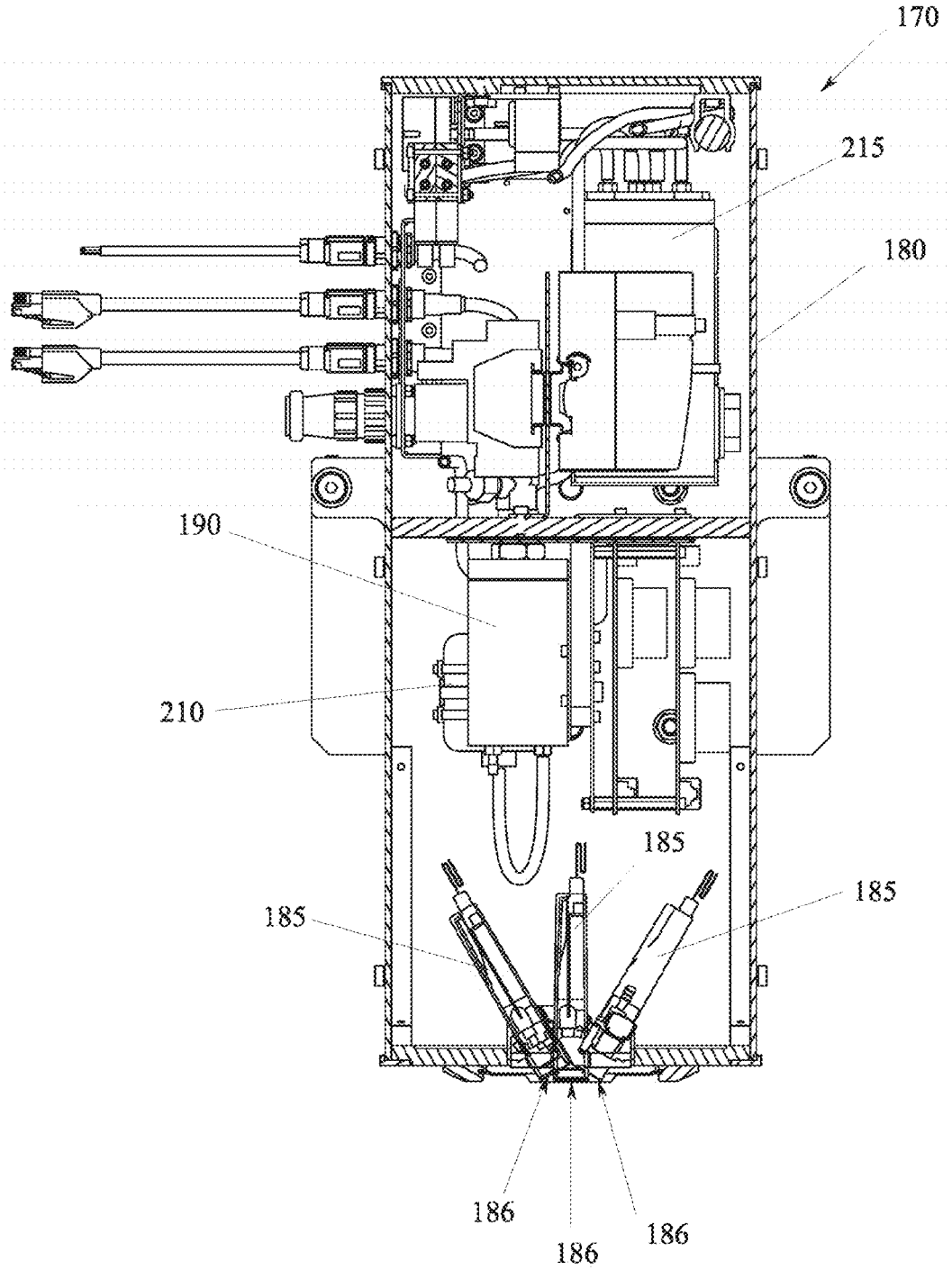
FIG. 8 is the section VIII-VIII indicated in FIG. 9.

Each printer head 185 generally comprises a multitude of minute nozzles (about 1000), generally having a diameter in the order of micrometres, each of which is designated to eject minute ink drops. These nozzles may be positioned close to each other on a single operating surface of the printer head 185, which can be a substantially rectangular-shaped flat surface. In the shown example, the printer heads 185 are parallelogram-shaped having a smaller thickness with respect to the length and width. The nozzles are positioned on one of the faces of the printer head 185 which define the thickness, the face 186 directed downwards (see FIG. 8) in this case.

Each printer head 185 further comprises a mechanism for ejecting ink drops (not visible), which enables commanding each nozzle to release the ink selectively. This mechanism may use various technologies, for example it may be of the thermal or piezoelectric type. In any case, the ejection mechanism can be commanded and controlled electronically.

As previously mentioned, the printer heads 185 are installed on the support structure 180 of the printing unit 170 so that the nozzles are directed downwards to release the ink on the cylindrical container A found in the printing station 155.

In the illustrated example, the printing unit 170 thus comprises a plurality of printer heads 185 arranged so that the faces 186 with the nozzles are arranged in succession along a direction parallel to the rotational axis X of the spindle 120 found in the printing station 155, so that the printer heads 185—in their entirety—are suitable to dispense ink on a strip of the support cylinder 135 which substantially continuously extends along a generatrix thereof preferably over the entire or almost entire length of the support cylinder 135.

However, it cannot be excluded that—in other embodiments—the number and/or the arrangement of the printer heads 185 may vary with respect to the one illustrated in the figures.

Back to FIG. 9, the printing unit 170 further comprises a first ink tank 190, which is installed on board the support structure 180 and directly supplies ink to the printer heads 185. The ink is supplied to the first tank 190 by an ink pump 195, which draws the ink from a second tank 200. The ink pump 195 and the second tank 200 are also both installed on the support structure 180. The second tank 200 is bigger than the first tank 190 and it is used for containing an amount of ink sufficient to confer good operative durability to the printing unit 170. The second tank 200 may be supplied with ink from the external, through a supply mouth obtained in the support structure 180 and provided with a closing cover 205. An ink filter 210 suitable to filter the ink coming from the second tank 200 may be interposed between the ink pump 195 and the first tank 190.

The printing unit 170 also comprises a vacuum tank 215, which is installed on board the support structure 180 and is connected with the first ink tank 190. Thus, the pressure of the ink inside the first tank 190, and thus also inside the printer heads 185, is maintained at lower values with respect to the atmospheric pressure, usually in slight depression. This slight depression has the function of controlling the meniscus shape that the ink forms inside the nozzles of the printer heads 185, so as to ensure that that ink can only flow out only due to the ejection mechanism.

The vacuum tank 215 is in turn kept in depression by a vacuum pump 220, which is also installed on board the support structure 180 of the printing unit 170. The vacuum pump 220 and the vacuum tank 215 may be provided with suitable pressure switches suitable to manage and control the pressure in the system.

On the support structure 180 of the printing unit 170 there are also mounted sensors suitable to detect various operating parameters of the ink system and/or vacuum system. These sensors may in particular, but not exclusively, comprise pressure sensors for detecting the pressure in the vacuum system and/or in the ink system, ink level sensors in the first tank 190 and/or in the second tank 200, possible temperature sensors etc.

The printing unit 170 further comprises an electronic apparatus, installed on board the support structure 180, which can be connected with the sensors and it is suitable to command and control the operation of at least the ink pump 195, the vacuum pump 220 and the printer heads 185. This electronic apparatus may for example comprise one or more printed circuit boards 225 for commanding and controlling the pumps 195 and 220 and one or more printed circuit boards 230 for commanding and controlling the printer heads 185.

On the support structure 180 of the printing unit 170 there may also be installed a power plug 235 for electrically supplying all electrical/electronic apparatus of the printing unit 170, particularly including the pumps 195 and 215, the printer heads 185, the pressure switches, the sensors as well as the control and command electronic apparatus. To this end, the power plug 235 may be connected, through a suitable connector, to a general electrical power supply circuit of the printing machine 100.

The printing unit 170 may also comprise one or more communication ports 240 for connecting the electronic apparatus that is installed on board the printing unit 170 with a central control and management system (not illustrated) of the printing unity 100. This enables establishing a data, commands and information exchange between the central control system and the electronic unit of the printing unit, through mutual transmission of signals. The communication ports 240 may be suitable to receive quick coupling/decoupling connectors and they may particularly include a data Bus connection port and a control Bus connection port. Also these communication ports 240 are mounted on board the support structure 180 of the printing unit 170.

Thus, in light of the above it is observed that the printing unit 170 is actually a stand-alone device which incorporates all the means required for the ink-jet printing and which can thus be mounted or demounted on the/from the printing machine 100 as single element, without having to act on the ink system, on the vacuum system, on the electrical/electronic cabling save the mere connection of the power supply and communication connectors.

Now back to FIGS. 6 and 7, the support and displacement system 175 of the printing unit 170 may comprise a connection flange 245, to which the support structure 180 of the printing unit 170 is fixed. To this end, the support structure 180 comprises a corresponding connection flange 250 suitable to be faced and fixed to the connection flange 245 of the support and displacement system 175.

In order to correctly position the printing unit 170, the connection flange 245 may comprise two or more positioning pins 255 (see FIG. 9), which are suitable to be inserted in corresponding holes of the connection flange 245. The fixing between the connection flange 245 and the connection flange 250 may then be obtained by means of resolvable fixing means i.e. fixing means that can be easily removed to dissolve the constraint between the two connection flanges 245 and 250. In the shown example, these fixing means are screw means, which for example may comprise a pair of threaded pins 260 that are freely inserted into special holes obtained in the connection flange 250 and which are screwed into the rearward threaded holes of the connection flange 245. These threaded pins 260 may be provided with a gripping element which enables screwing and unscrewing them manually. Thanks to these threaded pins 260 and the positioning pins 255, the printing unit 170 can be easily mounted and demounted by only one operator.

As illustrated in FIG. 6, the connection flange 245 of the support and displacement system 175 is constrained to a first carrier 265. Such constraint is obtained by means of a hinge joint 270 that defines a rotational axis Z horizontal and orthogonal to the rotational axis X of the spindle 120 found in the printing station 155.

Thus, the connection flange 245, alongside the entire printing unit 170, may be made to tilt around said rotational axis Z, so as to vary the inclination of the printer heads 185 with respect to the rotational axis X of the spindle 120. This adjustment possibility is particularly useful to enable the printing unit 170 to print conical objects in that it enables directing the printer heads 185 so that they are always parallel to the generatrixes of the surfaces to be printed.

The tilting of the connection flange may be actuated by a linear actuator 275, a screw linear actuator in this case, which is integrally associated to the first carrier 265 whose screw 280 is suitable to move vertically remaining at contact with a lever (not illustrated) which can be fixed to the connection flange 245 or directly to the support structure 180 of the printing unit 170. Thus, a downward displacement of the piston 280 actively causes an anticlockwise rotation of the connection flange 245 (with respect to the view of the FIG. 6), while an upward displacement of the piston 280 enables the connection flange 245 to rotate in the opposite direction, for example due to the weight thereof.

Besides this, the first carrier 265 is slidingly coupled to a guide column 285 that enables sliding in vertical direction, so as to raise or lower the connection flange 245 and the entire printing unit 170 therewith.

The sliding of the first carrier 265 may be actuated by an electric motor which drives a vertically oriented manoeuvre screw 290, which is engaged inside a spiral (not visible) fixed to the carrier 265, in rotation so that the rotation of the manoeuvre screw 290 is transformed into the sliding of the first carrier 265 on the guide column 285.

The guide column 285 and the manoeuvre screw 290 are in turn installed on a second carrier 295, which is slidably coupled to a horizontal guide 300 fixed to the second platform 165 and oriented parallel to the rotational axis X of the spindle 120 found in the printing station 155. Thus, the second carrier 295, alongside the connection flange 245 and the entire printing unit 170, may be displaced in the direction parallel to the support cylinder 135.

The sliding of the second carrier 295 may be actuated by an electric motor which drives a horizontally oriented manoeuvre screw 305, which is mounted on the second carrier 295 and is engaged inside a spiral (not visible) fixed to the second platform 165, so that the rotation of the manoeuvre screw 305 is transformed into the sliding of the second carrier 295 on the guide column 300.

Thus, in light of the above it is clearly observable that the support and displacement system 175 is generally capable of displacing the printing unit 170 along a vertical direction, along a horizontal direction parallel to the rotational axis X of the spindle 120 found in the printing station 155, as well as orienting it by driving it in rotation around a rotational axis Z horizontal and orthogonal to the rotational axis X of the spindle 120.

Lastly, each printing station 155 comprises a pull-out drawer 310, which is associated to actuation means that enable it to move in a direction parallel to the rotational axis X of the spindle 120, between an inoperative position (shown in FIG. 6) in which it is positioned beneath the platform 165, and an operative position (not shown) in which it is positioned beneath the printer heads 185 of the printing unit 170.

This pull-out drawer 310 carries a tray which enables receiving the ink which is ejected by the printer heads 185 during the execution of possible nozzle cleaning processes that may be sometimes carried out when the printing unit 170 is still installed on the printing machine 100.

Back to FIG. 1, the printing machine 100 also comprises a first conveying system 315 suitable to bring the tubular containers A to be printed to the input station 150, and a second conveying system 320 suitable to move the tubular containers A (already printed) away from the output station 160.

Figure 5:
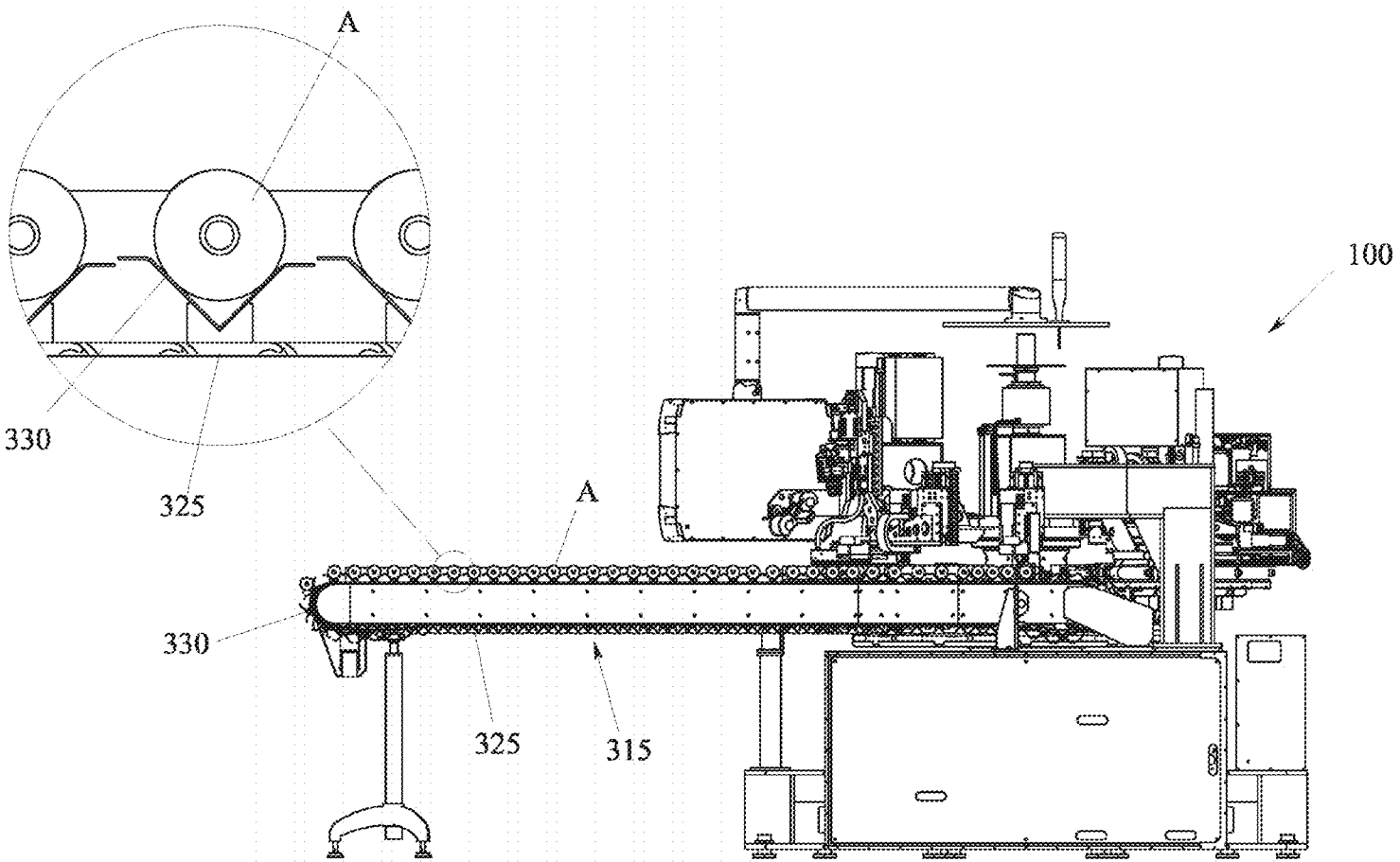
FIG. 5 is a lateral view of the machine of FIG. 1.

The first conveying system 315 comprises a conveyor belt 325 suitable to slide in a pre-set loop path that includes an operative upper portion, in which the conveyor belt 325 is suitable to convey the tubular containers A, and a lower return section, in which the conveyor belt 325 returns after releasing the tubular containers A at the input station 150 of the printing machine 100. In the illustrated embodiment, the conveyor belt 325 comprises a plurality of cradles 330 (also see FIG. 5), which are arranged in succession and preferably equally spaced along the sliding direction of the conveyor belt 325, and they are individually suitable to receive a tubular container A therein.

In detail, each cradle 330 is substantially configured as a work-piece with a straight axis and constant cross-section whose axis is arranged transversely with respect to the sliding direction of the conveyor belt 325, orthogonal in this case. The transversal section of the cradle 330 is an open section, so as to define a concavity which is faced upwards in the upper portion of the conveyor belt 325 and which is suitable to receive the tubular container A in the longitudinal direction. In other words, the tubular container A rests inside the aforementioned concavity so that the axis thereof is parallel to the axis of the cradle 330.

In the illustrated example, the transversal section of each cradle 330 is substantially V-shaped, so that the cradle 330 is capable of receiving variously shaped tubular containers A, in particular with different diameter, without requiring any structural modification.

The conveyor belt 325 is associated to driving means (not illustrated), which are suitable to make it slide step by step, stopping it for a period of time after each advancement step. In particular, the advancement of the conveyor belt 325 is programmed so as to sequentially stop each cradle 330 in a position for loading the tubular container A, in which said cradle 330 is aligned in an axial direction with respect to the support cylinder 135 of the spindle 120 found in the input station 150.

More in detail, in the loading position, the cradle 330 is positioned so that the tubular container A, conveyed by it, is coaxially aligned to the aforementioned support cylinder 135.

Figure 10:
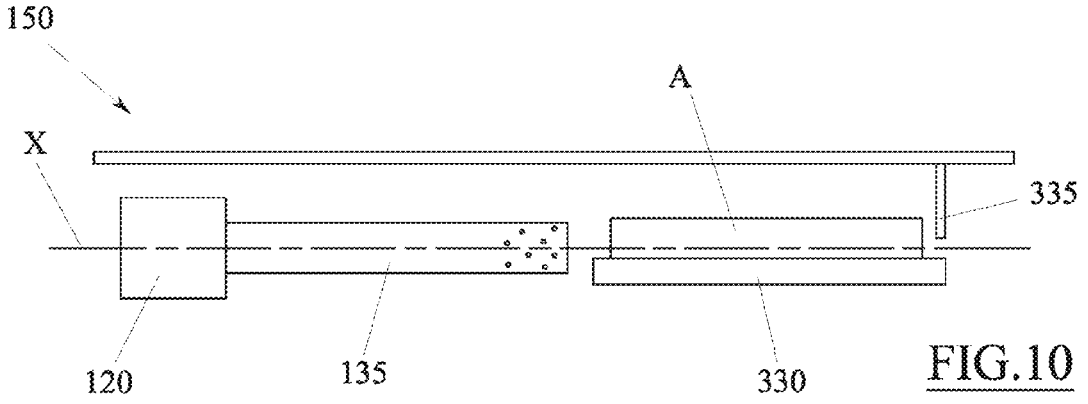
FIGS. 10 and 11 schematically show an input station of the machine of FIG. 1 in two different operating configurations.

As schematically illustrated in FIG. 10, the input station 150 of the printing machine 100 may comprise a pusher member 335, which is suitable to remain in an advanced position in which it is positioned behind the tubular container A found in a loading position, i.e. so that the tubular container A is interposed between said pusher member 335 and the support cylinder 135.

Figure 11:
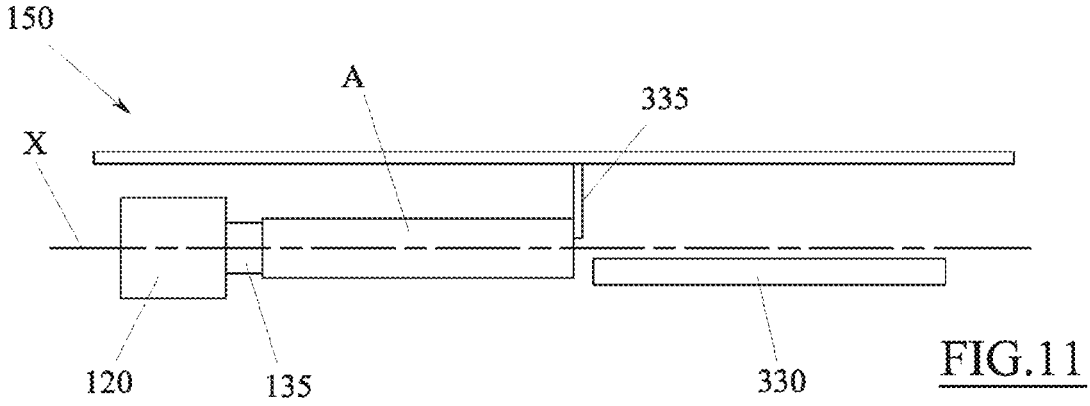

The pusher member 335 is associated to actuation means that enable it to move forward and backward in the direction parallel to the rotational axis X of the spindle 120, between the aforementioned advanced position towards a receded position (shown in FIG. 11), progressively approaching the support cylinder 135 and thus pushing the tubular container A for the insertion thereinto.

Upon inserting the tubular container A into the support cylinder 135, the pusher member 335 is once again actuated in an advanced position, awaiting for the conveyor belt 325 and the platform 110 to perform an advancement step, respectively carrying a new tubular container A and a new support cylinder 135 (empty) at the input station 150.

The second conveying system 320 (see FIG. 1) applies a technical solution analogous to the one just described above. As a matter of fact, also the second conveying system 320 comprises a conveyor belt 340 suitable to slide in a pre-set loop path that includes an upper operative portion, in which the conveyor belt 340 is suitable to convey the tubular containers A, and a lower return portion, in which the conveyor belt 340 returns after releasing the tubular containers A, for example inside a collection basket.

The conveyor belt 340 comprises a plurality of cradles 345 entirely similar, both from a structural and arrangement point of view, to the cradle 330 of the first conveyor belt 325, thus regarding whose description reference shall be made to what has been outlined above.

The conveyor belt 340 is associated to driving means (not illustrated), which are suitable to make it slide step by step, stopping it for a period of time after each advancement step. In particular, the advancement of the conveyor belt 340 is programmed so as to stop each cradle 345 in sequence in a position for receiving the tubular container A, in which said cradle 345 is aligned in an axial direction with respect to the support cylinder 135 of the spindle 120 found in the output station 160.

More in detail, in the reception position, the cradle 345 is positioned at a height substantially tangential to the generatrix beneath the support cylinder 135, or slightly lower, and oriented so that the axis thereof is parallel to the axis X of the spindle 120.

Figure 12:
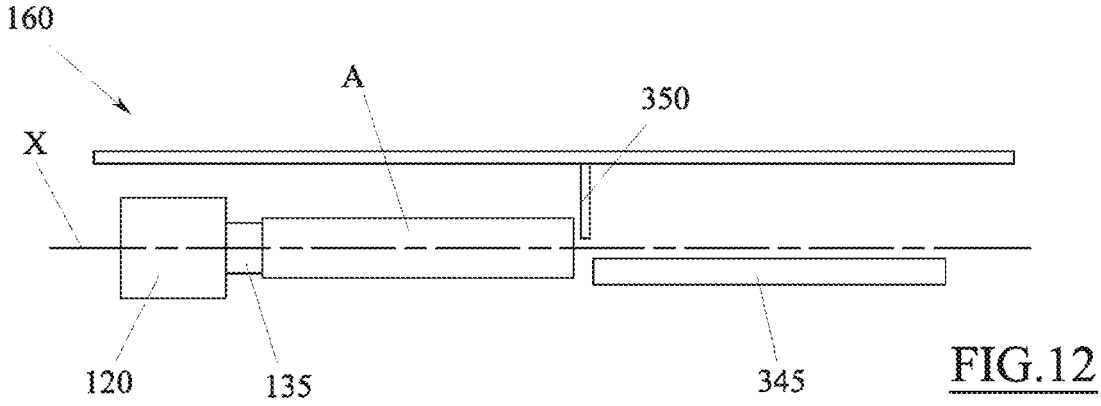
FIGS. 12 and 13 schematically show an output station of the machine of FIG. 1 in two different operating configurations.

As schematically illustrated in FIG. 12, the output station 160 of the printing machine 100 may comprise an abutment member 350, which is suitable to be positioned between the support cylinder 135 and the cradle 345 in a reception position.

Figure 13:
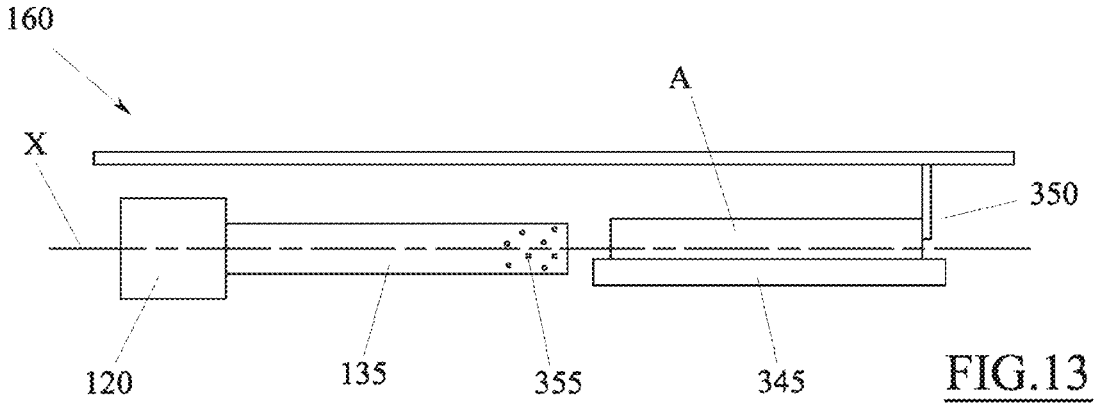
Figure 14:
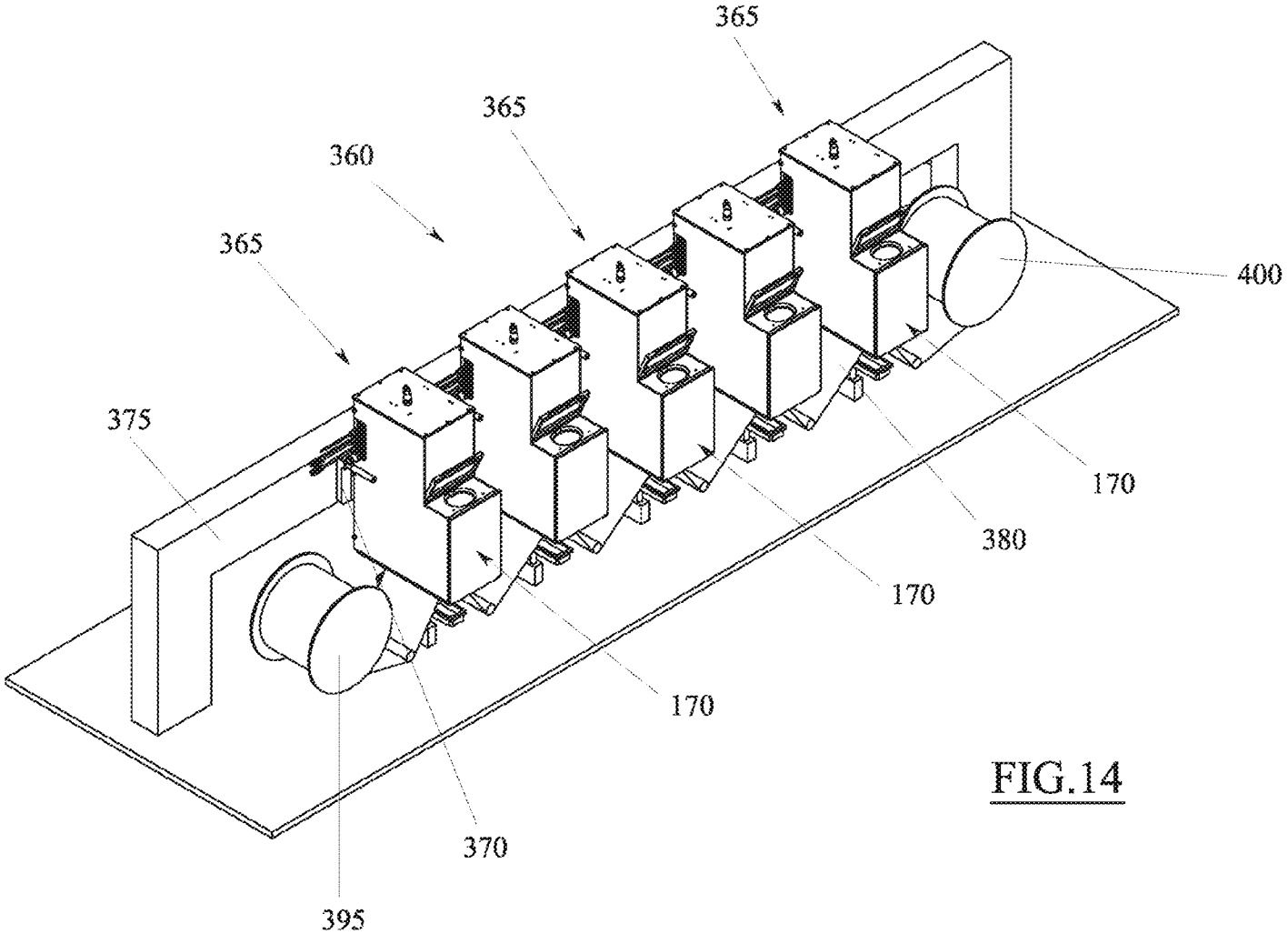
FIGS. 14 and 15 are an axonometric view of a service equipment according to the present invention shown in two different operating configurations.
Figure 15:
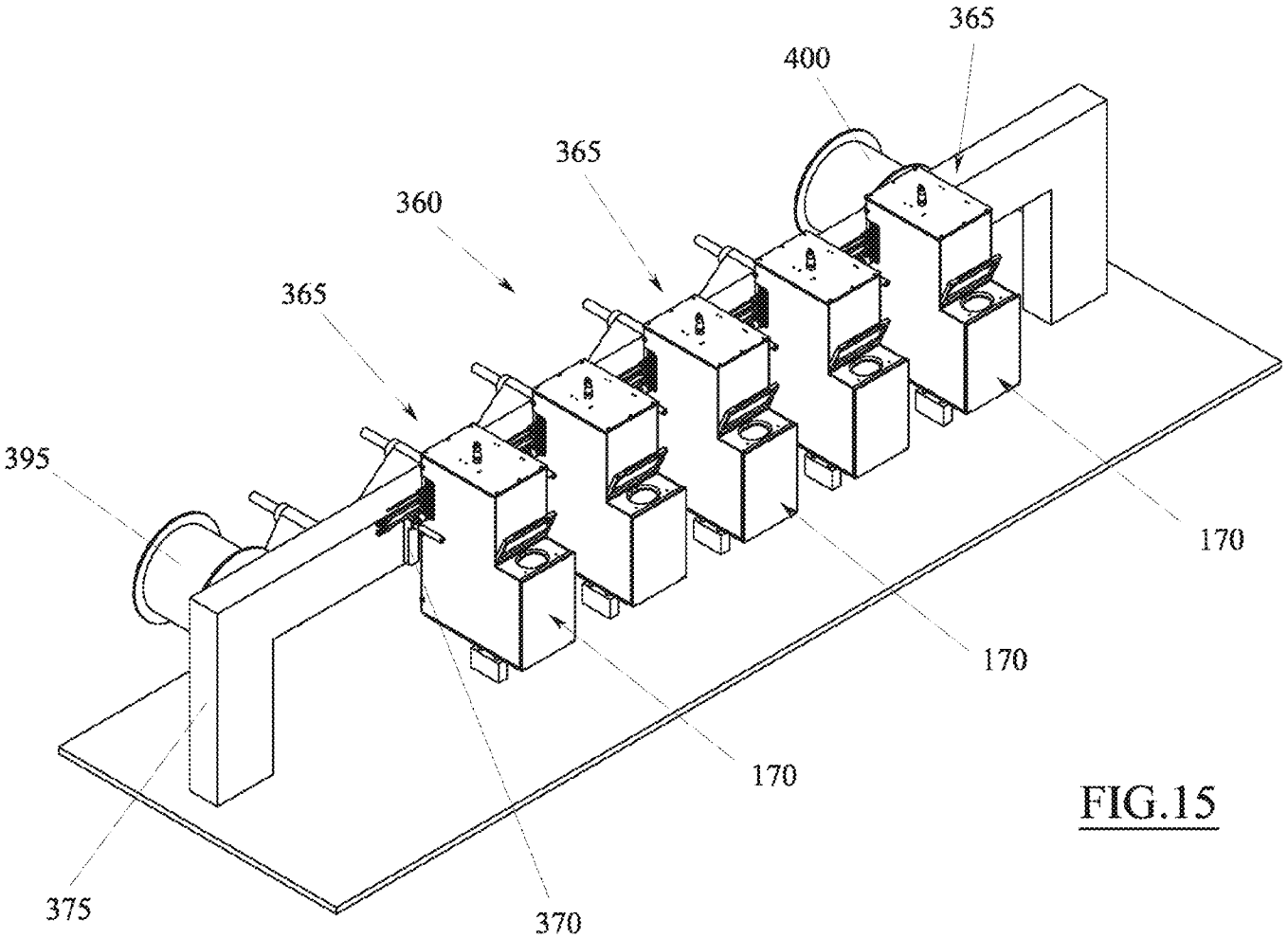
Figure 16:
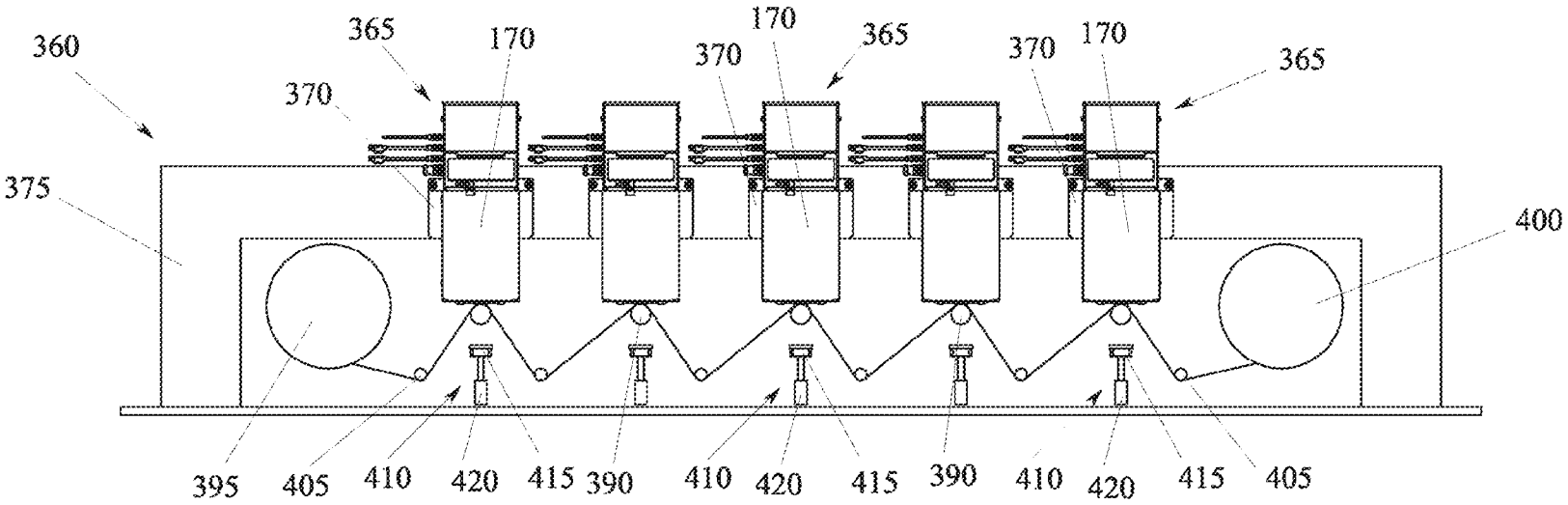
FIGS. 16 and 17 are a front view of the service equipment shown in two different operating configurations.
Figure 17:
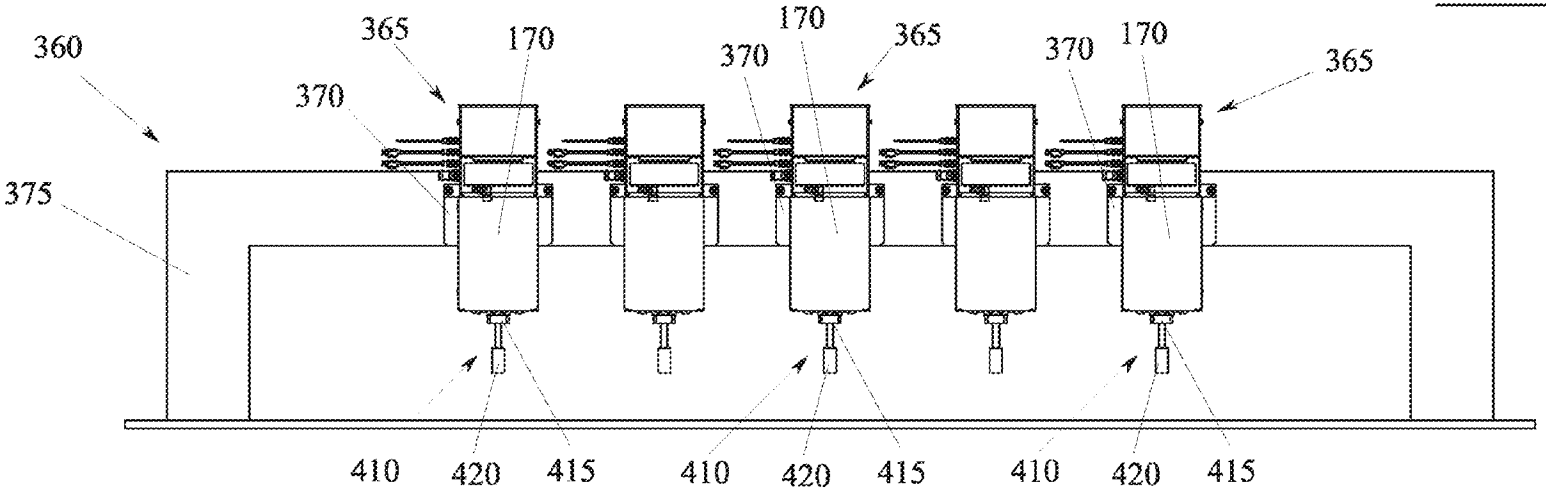

The support cylinder 135 may be provided with an ejection system which enables slipping the tubular container A off, making it advance towards the cradle 345. This ejection system may be a pneumatic system which, through a series of nozzles 355 obtained on the surface of the support cylinder 135 (see FIG. 13), is suitable to blow air into the interior cavity of the tubular container A, causing the progressive slipping off thereof.

While the tubular container A is being slipped off by the ejection system, the abutment member 350 is actuated to move in the direction parallel to the rotational axis X of the spindle 120, between the aforementioned receded position (illustrated in FIG. 12) and an advanced position (shown in FIG. 13), progressively moving away from the support cylinder 135 and thus accompanying the tubular container A until it rests on the cradle 345.

Once the tubular container A rests against the cradle 345, the conveyor belt 325 and the platform 110 perform an advancement step, respectively carrying a new cradle 345 (empty) and a new tubular container A at the output station 160, after which the abutment member 350 is actuated in the receded position once again.

The previously described conveying systems 315 and 320 have the important advantage of simplifying the format change, i.e. the re-configuration of the printing machine 100 so as to be able to pass from the processing of cylindrical container A of a given dimension, to the processing of cylindrical containers A of a different dimension, for example with different diameter. Due to the shape of the cradles 330 and 345 which enable receiving tubular containers A of various diameter and length, the change of format may actually be obtained by simply replacing the support cylinders 135 with others of more suitable diameter and adjusting the vertical position of the spindles 120, so that the rotational axis X thereof is at the appropriate height with respect to the cradles 330 and 345.

Another advantage of this solution lies in the fact that the cradles 330 and 345 are not rigidly connected to each other but can be mutually inclined (at least within a given limit) on the horizontal plane, thus enabling to configure each conveyor belt 325 and 340 so that the upper portion thereof comprises not only the perfectly straight portions but also at least slightly curved portions.

Figure 4:
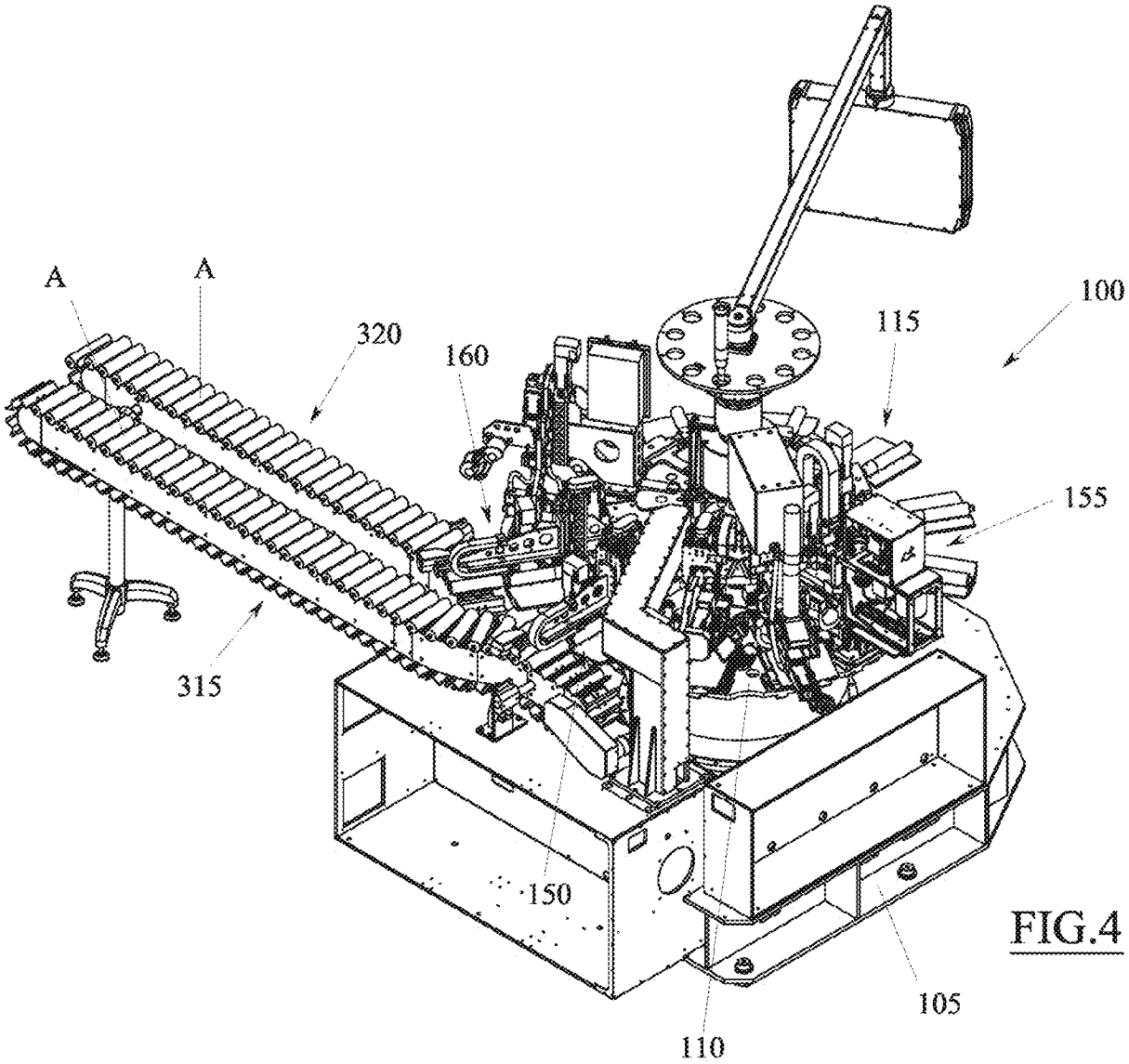
FIG. 4 is a second axonometric view of the machine of FIG. 1.

Thus, it is advantageously possible to configure the conveyor belts 325 and 340 so that most upper portions thereof are straight and parallel to each other as shown in FIGS. 1 and 4, reducing the empty and unusable space that separates them to the minimum.

Besides the printing machine 100, the system also comprises a service equipment 360, like the one illustrated in FIGS. 14 to 17, which is separate and independent from the printing machine 100 but it can be arranged close thereto.

The service equipment 360 comprises one or more operative stations 365, each of which comprises a connection flange 370 to which the support structure 180 of a printing machine 170 can be fixed. In particular, the connection flange 370 may be entirely similar to the connection flange 245 which is mounted on each support and displacement system 175 of the printing machine 100, and thus it can receive and be fixed to the connection flange 250 of the printing unit 170 in the same manner and using the same means as described above.

The connection flanges 370 may be fixed to a single support framework 375, which can be suitable to be placed on the floor, maintaining the connection flanges 370 and the printing units 170 in a raised position.

The surface equipment 360 further comprises an electrical supply system and a control and command electronic apparatus (not shown), which are suitable to be connected to each of the printing units 170 which are fixed to the connection flanges 370, for example through connectors which are coupled with the power plug 235 and with the communication ports 240, exactly as it occurs on the printing machine 100.

The electronic apparatus for controlling and commanding the service equipment 360 can be independent and autonomous with respect to the central control system of the printing machine 100, or it can be an integral part of the latter.

In any case, the electronic apparatus for controlling and commanding the service equipment 360 is above all configured to control the operation of the vacuum pump 220 and the ink pump 195 of the printing units 170, mainly with the aim of maintaining them in the same operating conditions they would have on board the printing machine 100.

Thus, the service equipment 360 is capable of maintaining the printing units 170 fully operative, ready to be possibly mounted and used.

Still with this aim, the electronic apparatus for controlling and commanding the surface equipment 360 may be configured to command the printer heads 185 of each printing unit 170 to periodically inject a small amount of ink, i.e. perform a procedure referred to as spitting.

This prevents the ink present in the nozzles of the printer heads 185 from solidifying following long inoperative periods thus fully or partly clogging the nozzles.

The electronic apparatus for controlling and commanding the surface equipment 360 may also be configured to command each printing unit 170 to perform a pre-set test printing on a suitable sample object 380, i.e. creating a determined graphic effect having pre-set chromatic and/or shape features on said sample object 380.

Regarding this, each operating station 365 of the service equipment 360 may comprise a spindle (not shown) suitable to drive a support cylinder 390 (see FIG. 16) in rotation around the central axis thereof. The spindle and the support cylinder 390 of each operating station 365 may be positioned, with respect to the printing unit 170 fixed to the relative connection flange 370, substantially in the same manner as the spindle 120 and the support cylinder 135 in the printing stations 155.

In the example shown in the figures, the sample object 380 on which the test printing is to be carried out is a belt which, unwinding from a first reel 395 and rewinding on a second reel 400, slides over the support cylinders 390 of all operating stations 365, guided by a series of further rollers 405 which are interposed between the support cylinders 390 and are positioned at a lower height with respect thereto.

In other embodiments, the sample object 380 could be a tubular body similar to the tubular containers A which are printed on the printing machine 100, which is directly inserted into the support cylinder 390 of the operating station 365.

In any case, the result of the test printing carried out on the sample object 380 can be compared with the expected result, i.e. with the graphic effect that should be obtained in conditions where the printing unit 170 operates in an optimal manner. Thus, the result of this comparison enables understanding whether the printing unit 170 operates correctly or whether it is faulty, for example whether some of the nozzles of the printer heads 185 are clogged or partly clogged.

This comparison may be carried out "manually" by sight by an operator, or it can be carried out automatically by the electronic apparatus for controlling and commanding the service equipment 360, which could be configured to acquire, through a special video or photo camera (not illustrated), images of the test printing carried out on the sample object 380 and thus compare them with the corresponding images of the expected result.

Should the comparison reveal defects, it is possible to activate restoration procedures, for example commanding the printing unit 170 to perform one or more spitting steps and/or subjecting the printer heads 185 to an actual cleaning step.

Regarding this, each operating station 365 of the service equipment 360 may comprise a device 410 for cleaning the printer heads 185 of the printing unit 170 from the external.

This cleaning device 410 may be associated to special actuator means capable of raising it from a lowered position (see FIG. 16), in which it is substantially inactive, to an operating position (see FIG. 17), in which it is arranged next to the printing unit 170, practically replacing the spindle and the support cylinder 390, which can be in turn associated to special actuator means capable of displacing them horizontally, possibly alongside the reels 395 and 400 and the rollers 405, between an advanced position (see FIG. 14), in which they are positioned beneath the printing unit 170, and a receded position (see FIG. 15), in which they are vertically misaligned with respect to the printing unit 170.

The cleaning device 410 comprises a tray 415 which, in the raised position, receives the lower face 186 of the printer heads 185 of the printing unit 170. This tray 415 is suitable to be filled with a liquid, for example water, suitable to submerge the lower face 186 and possibly the initial millimetres (e.g. 2 mm) of the printer heads 185 overlying the lower face 186.

The cleaning device further comprises a ultrasonic generator 420 to generate ultrasonic pressure waves which propagate in the liquid contained in the tray 415. Thus, the combined action of the liquid and the ultrasounds enables a thorough cleaning of the nozzles of the printer heads 185, sometimes even enabling the removal of the ink that may have dried therein.

The tray 415 may also be used for collecting small amounts of ink which are ejected by the printer heads 185, during the spitting procedures.

The operation of the system described above provides for equipping the printing machine 100, so that each printing station 155 is equipped with a respective printing unit 170. Each printing unit 170 may contain only one ink having a pre-set colour, for example cyan, magenta, yellow or black.

Printing occurs by loading the tubular containers A through an input station 150, as described previously. Due to the rotation of the first platform 110, each tubular container A is subsequently stopped at each printing station 155. At each printing station 155, the tubular container A is driven in rotation by the respective spindle 120, while the printer heads 185 of the printing unit 170 controllably dispense the ink on the lateral surface. In particular, the dispensing of the ink by the printing units 170 arranged on the printing machine 100 is controlled by an appropriate programme which is carried out by the central control system, so that, upon exit from the last printing station 155, the tubular container A is printed according to a pre-set pattern. Due to this technology, the pattern created on the tubular container A may thus be modified in a relatively quick and simple manner by means of an appropriate programming of the control centre, making the printing machine 100 extremely flexible. Upon completing the printing process, the tubular container A is moved away from the printing machine 100 through the output station 160, as described previously.

Generally, in order to enable the creation of printings having a wide range of chromatic effects, the printing stations 155 are equipped with printing units 170 containing different colours, preferably including at least one printing unit 170 containing cyan ink, a printing unit 170 containing magenta ink, a printing unit 170 containing yellow ink and a printing unit 170 containing black ink. At the same time, in order to avoid excessively increasing the overall dimension of the printing machine 100, the overall number of printing stations 155 should be maintained rather small (e.g. 7 printing stations 155) in any case. Thus, the tubular containers A are substantially printed in a "single pass", i.e. by applying each colour only once.

To enable this without jeopardising the productivity of the printing machine 100 it is generally preferable that the finished and/or not perfectly functional printing units 170 be replaceable easily and quickly. To attain this object, one or more spare printing units 170 can be mounted on the service equipment 360, where they are maintained perfectly operative due to the control of the vacuum 220 and ink 195 pumps, the periodical execution of the spitting steps, as well as the possible performance of printing tests and/or cleaning of the nozzles, as outlined previously.

Thus, when the finished or malfunctioning printing unit 170 is demounted from the printing machine 100, one of the printing units 170 arranged in the service equipment 360 can be rapidly picked up and used to replace the previous one, thus reducing the shutdown times of the printing machine 100 to the minimum.

The same principle also applies in cases where, for example following a modification in the printing programme, one of the printing units 170 mounted on the printing machine 100 requires replacement with a printing unit 170 having an ink of a different colour.

In any case, the printing unit 170 which is demounted from the printing machine 100 may in turn be mounted on the service equipment 360, so as to be kept active for future use and/or to be subjected to a procedure for washing the nozzles of the printer heads 185, if necessary.

Obviously, the printing machine 100 and the service equipment 360 may be subjected—by a man skilled in the art—to numerous technical and application modifications, without departing from the scope of protection of the invention as claimed below. In particular, it should be observed that all the steps for controlling the operation described above, may be carried out indistinctly by the central system for controlling the printing machine 100 and/or by the system for controlling the service equipment 360 and/or by the apparatus for controlling the single printing units 170, even where indicated otherwise.

The invention claimed is:

1. A machine for ink-jet printing of three-dimensional objects, comprising:

a plurality of spindles individually configured and operable to carry and drive an object to be printed in rotation around a pre-set rotational axis of the spindle, and a first support and displacement system configured and operable to move the plurality of spindles in succession along a pre-set loop path, stopping the plurality spindles one after another in a plurality of operating stations, wherein each of said plurality of operating stations comprise:

at least one input station wherein a respective one the plurality of spindles receives an object to be printed, a plurality of printing stations wherein the object is ink-jet printed, and at least one output station wherein the printed object is removed from the respective one of the plurality of spindles, wherein each of the plurality of printing stations comprises:

a printing unit configured for ink-jet printing the object carried by the respective one of the plurality of spindles found in the printing station, and a second support and displacement system configured and operable to vary a relative position of the printing unit with respect to the respective one of the plurality of spindles found in the printing station, and wherein each of said printing units comprises at least:

one or more ink-jet printer heads, one ink tank, one ink pump configured and operable to transfer ink from a tank to the one or more ink-jet printer heads, one vacuum pump configured and operable to create depression in the one or more ink-jet printer heads, and one electronic apparatus for controlling and commanding the ink pump, the vacuum pump and the one or more ink-jet printer heads.

2. The machine according to claim 1, wherein each of the second support and displacement systems comprise:

a connection element on which the printing unit is fixed, a first apparatus configured and operable to displace said connection element along a first direction parallel to the pre-set rotational axis, a second apparatus configured and operable to displace said connection element along a second direction perpendicular to the pre-set rotational axis, and a third apparatus configured and operable to rotationally direct said connection element around an axis orthogonal to both said first and second directions.

3. The machine according to claim 2, wherein each of the printing units is fixed to the connection element by a resolvable fixing means.

4. The machine according to claim 1, wherein the first support and displacement system comprises a platform configured and operable to rotate around a pre-set revolution axis, on which the plurality of spindles are installed according to a radial arrangement with the respective pre-set rotational axes directed orthogonally to the pre-set revolution axis.

5. The machine according to claim 4, wherein each of the plurality of spindles is associated with a third support and displacement system configured and operable to displace said each of the plurality of spindles in a direction parallel to the pre-set revolution axis of the platform.

6. The machine according to claim 1, wherein each of the plurality of spindles is associated with a lamp configured and operable to dry ink released on the object to be printed, said lamp being integrally movable with the respective spindle along the loop path defined by the first support and displacement system apparatus.

7. The machine according to claim 1, wherein a support cylinder configured to be inserted into the object to be printed is associated with each of the plurality of spindles.

8. The machine according to claim 7, comprising a first conveyor belt provided with a plurality of cradles individually configured to receive an object to be printed, said first conveyor belt being configured and operable to stop each of the plurality of cradles in a release position in which said each of the plurality of cradles is longitudinally aligned with the support cylinder of the spindle found in the at least one input station, and wherein the at least one input station comprises a pusher member configured to push an object to be printed arranged in the cradle found in the release position to insert it into the support cylinder.

9. The machine according to claim 8, comprising a second conveyor belt provided with a plurality of cradles individually suitable to receive a printed object, said first second conveyor belt being suitable to stop each cradle in a reception position in which said cradle is longitudinally aligned with the support cylinder of the spindle found in the output station, and wherein the output station comprises a system for transferring the printed object from the support cylinder found in the output station to the cradle found in the reception position.

10. The machine according to claim 9, wherein said second conveyor belt comprises at least one section that is straight and parallel to a section of the first conveyor belt.

11. A system for the ink-jet printing of three-dimensional objects, comprising:

the machine according to claim 1, and a service equipment, wherein said service equipment comprises at least:

one connection element on which a printing unit of the machine can be fixed, and an electronic system that can be connected with the electronic apparatus for controlling and commanding said printing unit, wherein said electronic system is configured at least for:

enabling the operation of the vacuum pump and the ink pump, commanding the printer heads to periodically release a small amount of ink.

12. The system according to claim 11 wherein said electronic system is further configured to command the printer heads to perform a pre-set test printing on a sample object.

13. The system according to claim 12, wherein said service equipment comprises a device for cleaning the printer heads of the printing unit.

14. The system according to claim 13, wherein said device for cleaning the printer heads comprises:

a tray for containing a liquid suitable to touch the printer heads, means for generating and propagating ultrasonic waves in the liquid contained in the tray.

* * * * *